US008051541B2

(12) United States Patent
Gupta

(10) Patent No.: US 8,051,541 B2
(45) Date of Patent: Nov. 8, 2011

(54) STRINGED BEAD SECUREMENT DEVICE

(76) Inventor: Nikhil Gupta, Schaumburg, IL (US)

( * ) Notice: Subject to any disclaimer, the term of this patent is extended or adjusted under 35 U.S.C. 154(b) by 381 days.

(21) Appl. No.: 12/383,494

(22) Filed: Mar. 25, 2009

(65) Prior Publication Data

US 2009/0260200 A1 Oct. 22, 2009

Related U.S. Application Data

(60) Provisional application No. 61/070,716, filed on Mar. 25, 2008.

(51) Int. Cl.
*B42F 1/08* (2006.01)

(52) U.S. Cl. ..... 24/549; 24/131 R; 24/67.3; 24/67.5; 24/115 N; 24/499; 24/508; 24/509

(58) Field of Classification Search ..... 24/67.3, 24/67.5, 67.7, 115 N, 131 C, 131 R, 499–501, 24/508, 509, 549, 550, 553, 554, 557, 565, 24/567; 211/120; 402/26, 35, 57; 267/69, 267/166; 248/468

See application file for complete search history.

(56) References Cited

U.S. PATENT DOCUMENTS

| | | | | | |
|---|---|---|---|---|---|
| 245,464 | A * | 8/1881 | Eby | 24/550 |
| 460,754 | A * | 10/1891 | Moxley | 24/67.7 |
| 489,794 | A * | 1/1893 | Dyre | 24/67.9 |
| 539,916 | A * | 5/1895 | Hilliker et al. | 119/812 |
| 1,088,553 | A * | 2/1914 | Dostal, Jr. | 24/501 |
| 1,452,860 | A * | 4/1923 | Wilburger | 402/53 |
| 1,854,740 | A * | 4/1932 | Hoag | 248/468 |
| 2,455,258 | A * | 11/1948 | Levitin | 24/501 |
| 2,456,302 | A * | 12/1948 | Mocnik | 248/468 |
| 2,537,703 | A * | 1/1951 | Randa | 248/75 |
| 3,613,897 | A * | 10/1971 | Filler | 211/120 |
| 4,175,306 | A * | 11/1979 | Bigelow et al. | 24/507 |
| 5,249,336 | A * | 10/1993 | Miller | 24/67.5 |
| 5,546,640 | A * | 8/1996 | Kronauer et al. | 24/510 |
| 6,842,951 | B1 * | 1/2005 | Barre et al. | 24/499 |
| 7,051,414 | B2 * | 5/2006 | Swanson | 29/433 |
| 7,083,057 | B1 * | 8/2006 | Hatch | 211/120 |
| 7,120,970 | B2 * | 10/2006 | Thomson et al. | 24/67.5 |

* cited by examiner

*Primary Examiner* — Robert Sandy
*Assistant Examiner* — Tyler Johnson
(74) *Attorney, Agent, or Firm* — Robert S. Alexander

(57) ABSTRACT

The present invention is directed toward a bead securement device comprising a tension spring, a first cover and a second cover. The first cover and the second cover are removably secured to the tension spring. In use, a force is exerted on the spring through the covers causing the spring to deform and the gaps between the plurality of coils on the spring expand. Once expanded, the filament may be passed in between one of these gaps so that when the force exerted on the end members of the spring is released, the filament is squeezed between the coils of the spring and held in place. The filament can be easily removed by using the covers to manipulate the end members of the spring.

12 Claims, 4 Drawing Sheets

Fig. 5
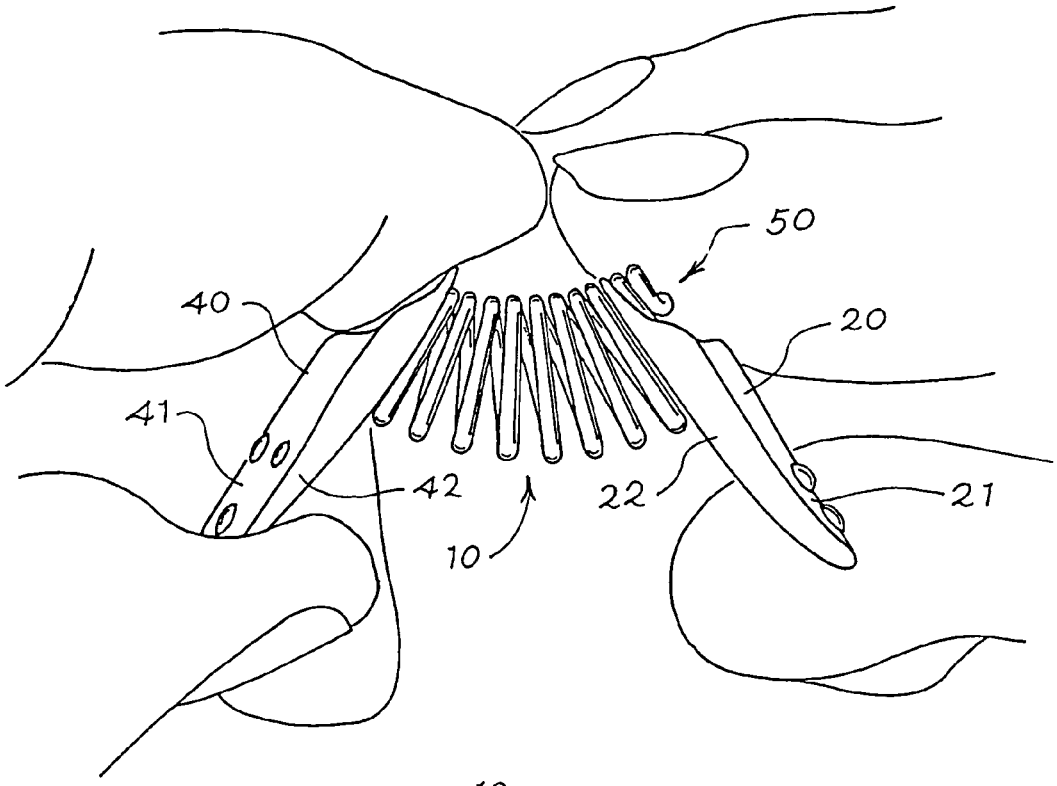
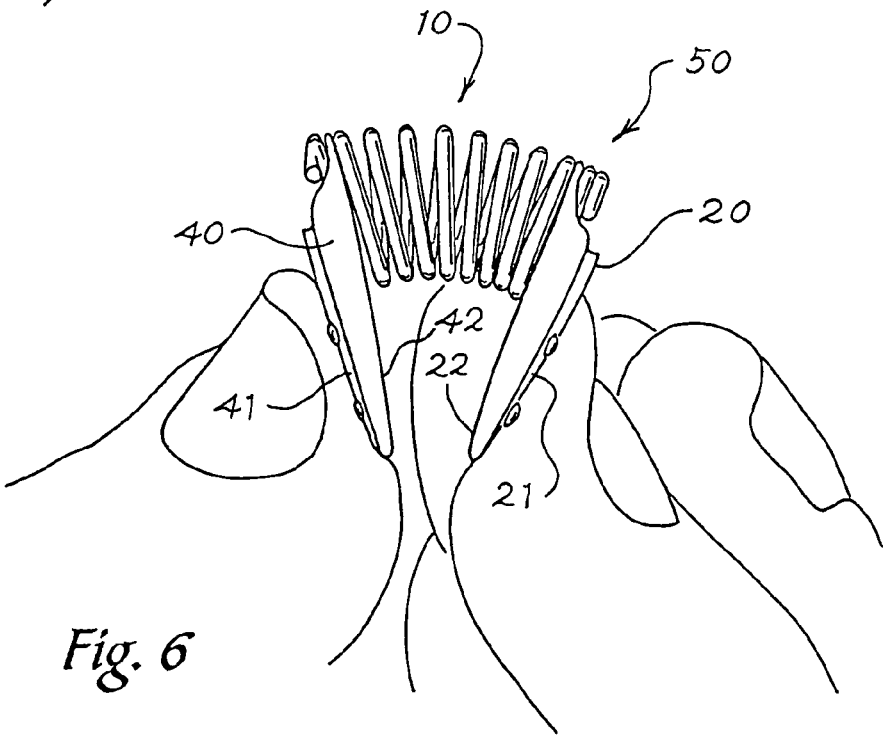
Fig. 6

STRINGED BEAD SECUREMENT DEVICE

CROSS-REFERENCE TO RELATED APPLICATION

This application claims the priority of Provisional Patent Application Ser. No. 61/070,716 filed on Mar. 25, 2008 which is incorporated herein by reference.

FIELD OF THE INVENTION

The present invention relates generally to a device for securing beads on a string.

BACKGROUND OF THE INVENTION

In the course of making jewelry, decorative beads are often strung onto a filament or line to create decorative necklaces or bracelets. As the filament holds more beads, it becomes progressively more difficult to prevent beads from sliding off the end of the filament. It is also sometimes desirable to store an uncompleted project between uses. Without a mechanism to secure the end of the filament, the careful arrangement of beads may be lost as the strung beads slide off the end of the filament. This can result in hours of lost work and significant frustration.

In order to avoid these problems, it is desirable to be able to prevent beads from slipping or sliding off the filament during the creation of the design. It is further desirable that this process be easy to apply and remove, since a permanent application such as a knot or a glued bead would adversely affect the aesthetic and functional characteristics of the finished product.

U.S. Pat. No. 7,051,414 discloses a method of retaining components strung on a wire. The method requires the user to directly squeeze the angled end members of a coiled spring. Various problems arise with this arrangement. Since the end members of the coiled spring are thin in profile, when the end members are manipulated a substantial concentration of force is exerted on the user's fingertips. This can cause undesirable pain and discomfort to the user during the operation of the securement device. Moreover, the end members of the spring provide little traction or grip during use.

In order to alleviate these problems, the invention disclosed herein, includes covers that are releasably engaged to each end member. Each cover is adapted to fit and couple with the end member of the tension spring. Preferably, the cover is also flattened so that the force from the manipulation of the end members is distributed over a wider surface area, thereby reducing the user's discomfort. It is also desirable that the cover be textured to provide improved traction and grip during use. There is thus a need for a convenient device that can be used to secure and prevent a set of beads from sliding off the end of a filament line.

SUMMARY OF THE INVENTION

The present invention is directed toward a device used to secure beads and other embellishments on a wire or filament. The device comprises a tension spring and two end covers detachably secured to the spring. The tension spring has a plurality of coils with a first end and a second end. A first end member is formed at the first end and a second end member is formed at the second end. Each cover contains a slot configured to receive the end member on each end of the tension spring. When the securement device is assembled, the first end member of the first end is removably engaged within the first slot of the first cover and the second end member of the second end is removably engaged within the second slot of the second cover.

In use, force is translated to the spring by way of force exerted on the covers. Such forces cause the spring to deform and the gaps between the plurality of coils on the spring to expand. Once expanded, the filament may be passed in between one of these gaps so that when the force exerted the spring is released, the filament is squeezed between the coils of the spring and held in place. The filament can be easily removed by manipulating the covers secured to the end members of the spring.

BRIEF DESCRIPTION OF THE DRAWINGS

FIG. 5 is a schematic representation of the invention in use;

FIG. 6 is a schematic representation of the invention in use; and

DESCRIPTION OF THE PREFERRED EMBODIMENTS

Figure 1:
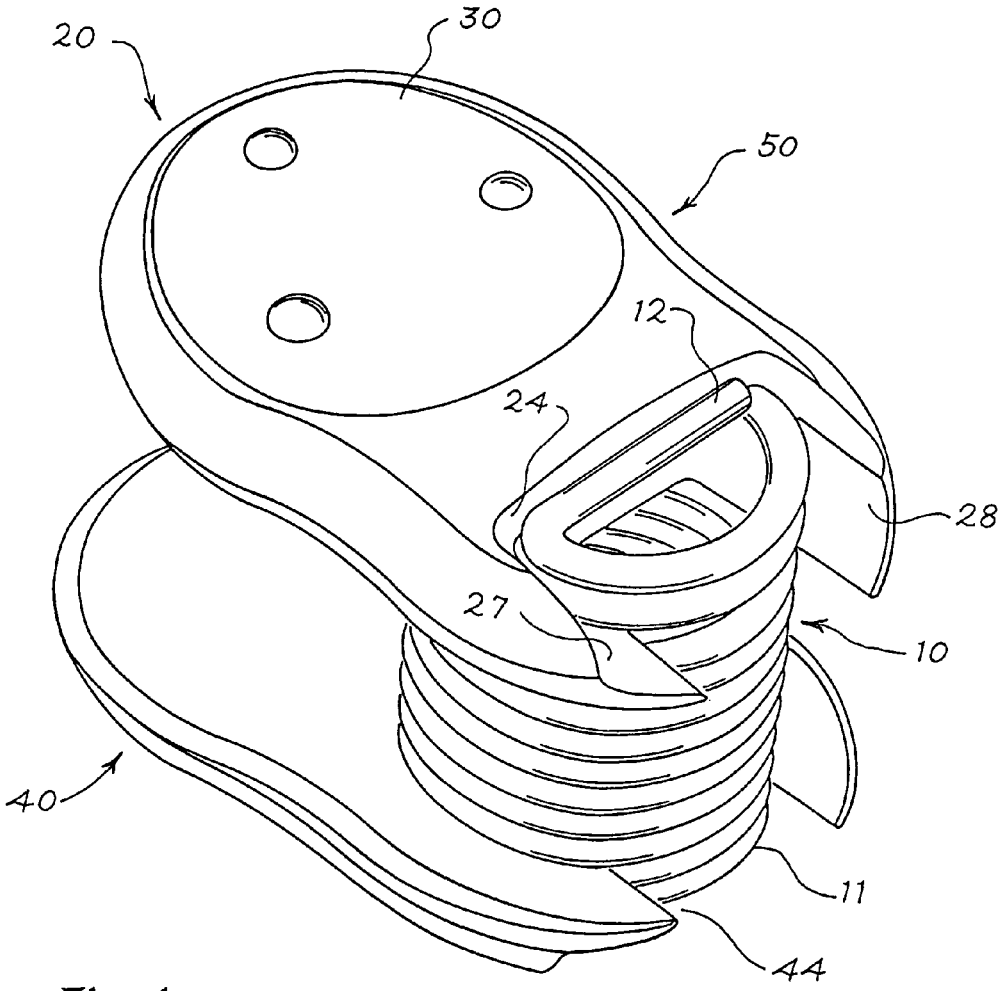
FIG. 1 is a perspective view of a preferred embodiment of the present invention.

The present invention is directed to a device for securing beads on a string or wire. The invention disclosed herein is, of course, susceptible of being embodied or conducted in many different manners. Shown in the drawings and described herein below in detail is a preferred embodiment of the invention. It is to be understood, however, that the present disclosure is an exemplification of the principles of the invention and does not limit the invention to the illustrated embodiment.

Figure 7:
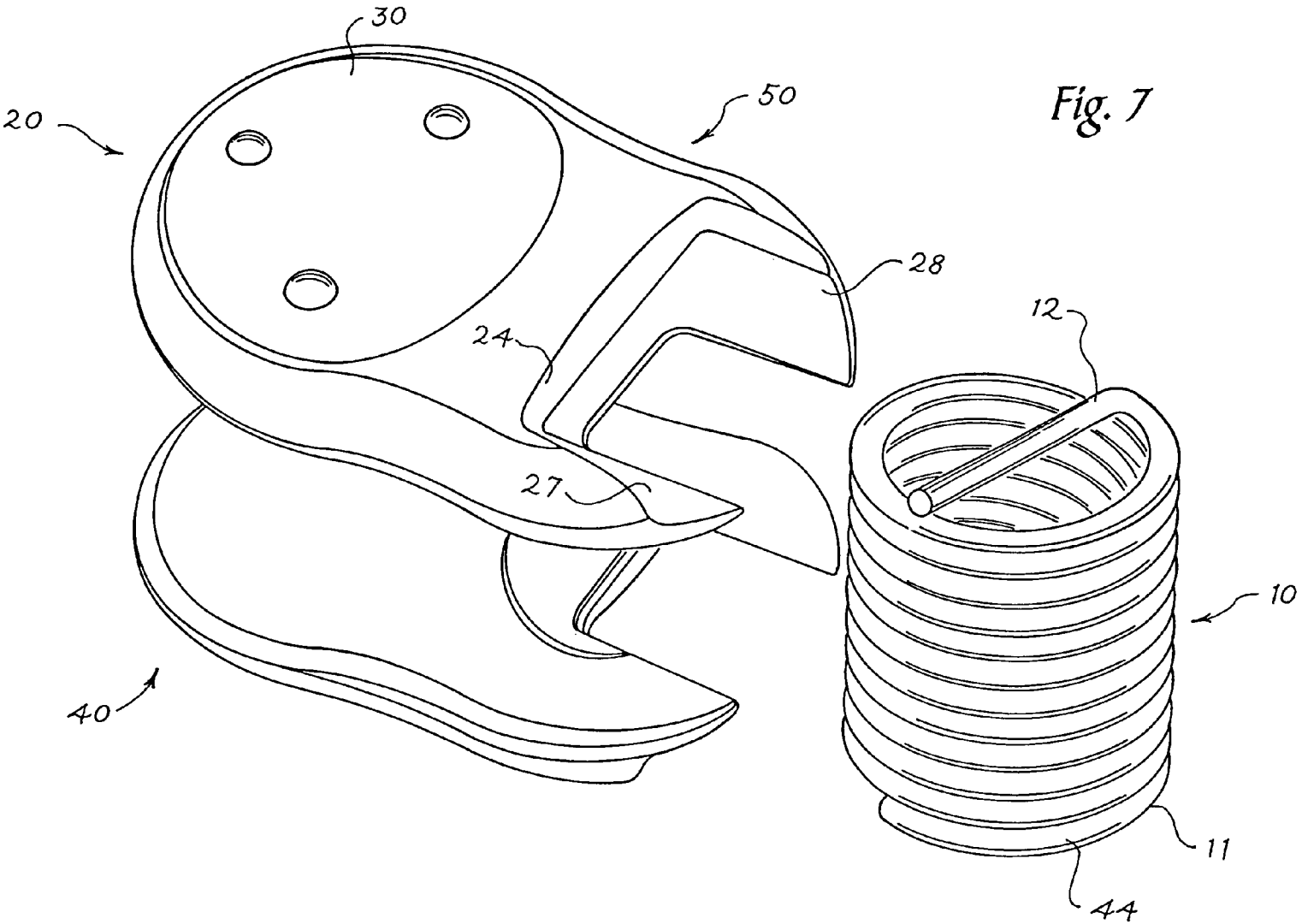
FIG. 7 is an exploded perspective view of the device in FIG. 1.

Referring to FIGS. 1 and 7, in accordance with a preferred embodiment of the present invention, a perspective view of the securement device 50 is shown. The securement device 50 comprises a spring 10, a first cover 20 and a second cover 40.

The spring 10 is an extension or compression spring with a plurality of coils 11 between a first end member 12 and a second end member 13 (not shown). The first end member 12 and the first end member 13 are integrally formed with the spring 10 and are preferably identical. The first end member 12 and the second end member 13 include closed end hooks that are parallel with the plurality of coils 11. However, other spring ends generally known in the art such as open ends or loops could be utilized. The characteristics of the spring 10 are chosen so that when the spring 10 is at rest, the spacing and spring force between the plurality of coils 11 is sufficient to secure a filament line (as shown in FIG. 8). The spring is preferably made of metal, but can be coated with or manufactured from a plastic, nylon or brass.

Figure 4:
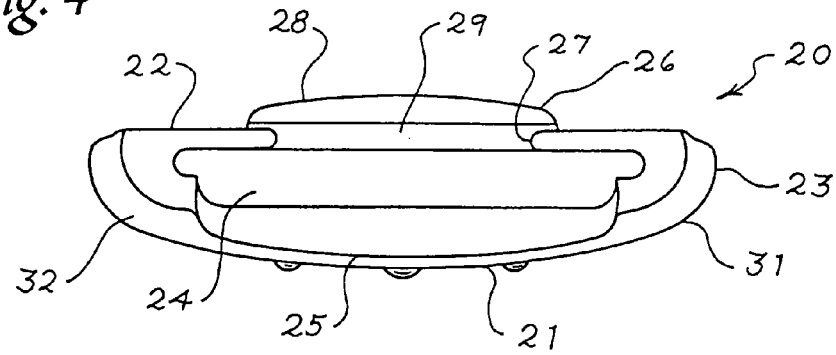
FIG. 4 is a side view of the cover shown in FIG. 1.
Figure 2:
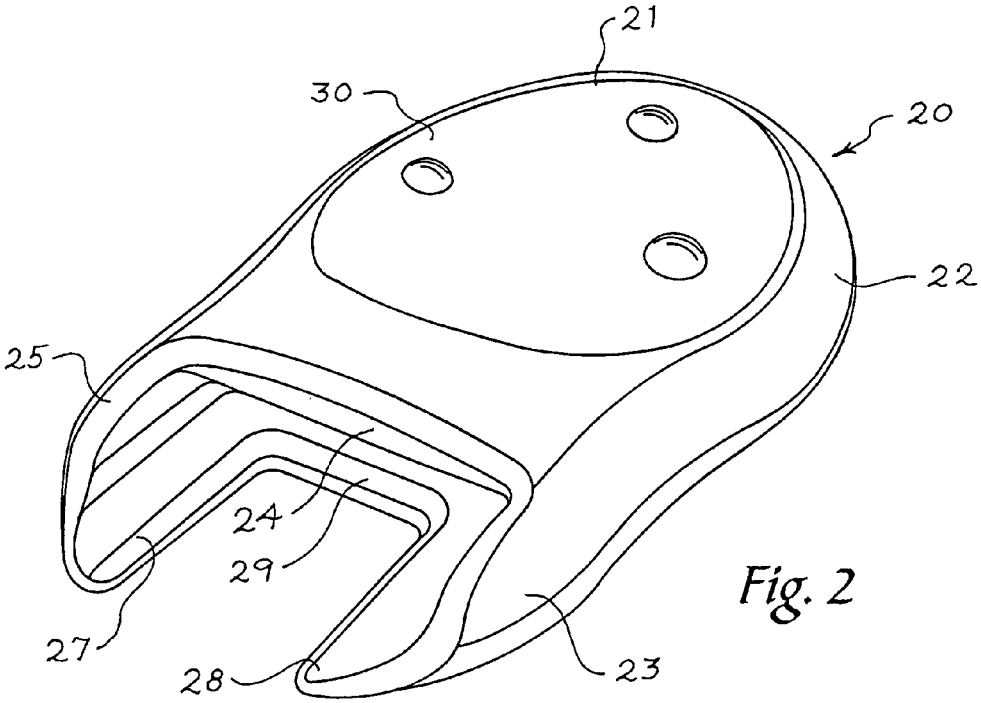
FIG. 2 is a top view of the cover shown in FIG. 1.
Figure 3:
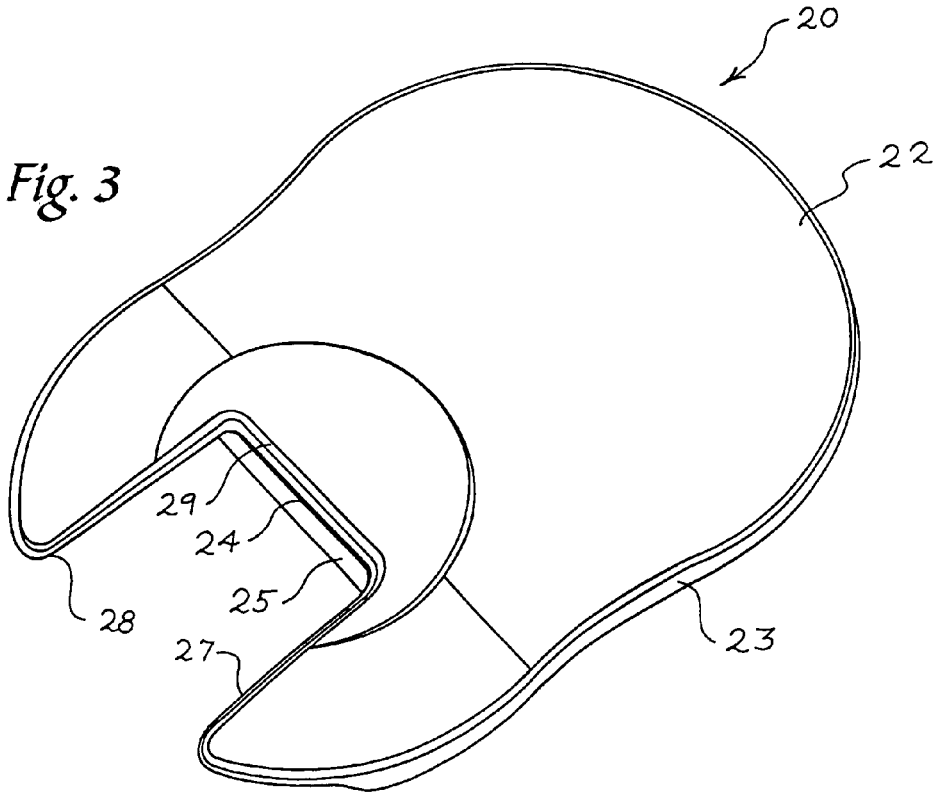
FIG. 3 is a bottom view of the cover shown in FIG. 1.

Referring to FIGS. 2-4, the first cover 20 includes a top 21, a bottom 22 and a rim 23 connecting the top 21 and the bottom 22. In the preferred embodiment, the first cover 20 is flattened so that force from the manipulation of end members is distributed over a wide surface area, reducing user discomfort. The first cover 20 is preferably made of a material that will transmit force but is comfortable to a user when force is applied, such as rubber or plastic.

In the preferred embodiment the top 21 further comprises a textured portion 30. The textured portion 30 may be integrally formed with the first cover 20 but such integration is not required. It is also not required that the textured portion 30 is composed of the same material as the cover 20. For example, the textured portion 30 could be composed of a material different from the first cover 20 such as textured paper or felt. In other embodiments a textured portion is not required.

The bottom 22 further includes a retaining member 26. The retaining member 26 is constructed to fit within the plurality of coils 11 of the spring 10. The retaining member 26 is sloped downwards from the middle of the bottom 22 toward a slot 24. Although such slope aids in the attachment and removal of the first cover 20 from the spring 10, it is not essential. The retaining member 26 aids in the alignment and securement of the spring 10 with the first cover 20. When the plurality of coils 11 are properly aligned with the retaining member 26, a "click" is made as a result of the friction caused between the plurality of coils 11 and the retaining member 26. However, such retaining member is not required in all embodiments. In the preferred embodiment the retaining member 26 is integrally formed with the first cover 20.

The rim 23 further comprises the slot 24. The slot 24 is configured to removably secure the first cover 20 with the first end member 12. The top slot edge 25 is the portion of the slot 24 aligned with the top 21. In the preferred embodiment, the outline of the top slot edge 25 is generally U-shaped. However, the top slot edge 25 may be any other shape as long as the cover 20 is removably secured with the first end member 12. When the securement device 50 is assembled, the top slot edge 25 in configured so that the first end member 12 abuts the top slot edge 25.

The top slot edge 25 is connected with the bottom slot edge 29 by a first side edge 31 and a second side edge 32. The bottom slot edge 29 is the portion of the slot 24 aligned with the bottom 22. The outline of the bottom edge 29 is generally U-shaped and forms a first support tab 27 and a second support tab 28. The bottom edge 29 does not have to be U-shaped and may be any other shape as long as the first cover 20 is removably secured with the first end member 12 of the spring 10.

When the securement device 50 is assembled, the first cover 20 is removably engaged with the first end member 12 and the second cover 40 is removably engaged with the second end member 13 (not shown). In the preferred embodiment, the first cover 20 is removably secured to the spring 10 between the first end member 12 and the plurality of coils 11. When the spring 10 is removably engaged with the cover 20, the first end member 12 rests on the first tab member 27 and the second tab member 28 and thus rests on the bottom 22. Additionally, the plurality of coils 11 are aligned over the retaining member 26. The second cover 40 is identical to the first cover 20 and is removably secured to the spring 10 in a similar fashion. When the first cover 20 and the second cover 40 are attached to their respective end members. A mechanical advantage is achieved by serving as a lever arm extension of the spring coil end member, reducing the overall force needed to be applied by the user in order to distort the spring in operation.

FIGS. 5-6 describe the securement device in use. In use, the first end member 12 and the second end member 13 are manipulated by the first cover 20 and the second cover 40, respectively, to stretch the spring 10.

As shown in FIG. 6, the first cover 20 and the second cover 40 are squeezed toward each other by exerting a force on the top 21 and the top 41. Since the first end member 12 and the second end member 13 are secured to the first cover 20 and the second cover 40, respectively, the force is translated to the end members, which are also moved in the direction of the force exerted on the covers. Such forces cause the spring 10 to deform and stretch the gap between the plurality of coils 11. In operation, the filament (not shown) can be passed in between one of these gaps so that when the force exerted through the first cover 20 onto the first end member 12 and the second cover 40 on the second end member 13 is released, the filament is squeezed between the plurality of coils 11 of the spring 10 and the filament is held in place. Similarly, the filament can be easily removed by pressing the first cover 20 and the second cover 40 toward each to deform the spring 10 and thus release the trapped filament from between the plurality of coils 11. In the preferred embodiment, a relatively equal force is exerted on both the first cover 20 and the second cover 40 to move the two covers toward each other and thus deform the spring 10.

As shown in FIG. 7, the spring 10 is deformed by causing the bottom 22 of the first cover and the bottom 42 of the second cover to move away from each other. Since the first end member 12 and the second end member 13 are secured to the first cover 20 and the second cover 40, the end members are also moved in the direction of the force exerted on the covers. The forces exerted on each of the covers cause the spring 10 to deform and stretch the gap between the plurality of coils 11. In operation, the filament (not shown) can be passed in between one of these gaps so that when the force exerted through the first cover 20 onto the first end member 12 and the second cover 40 on the second end member 13 is released, the filament is squeezed between the plurality of coils 11 of the spring 10 and the filament is held in place. Similarly, the filament can be easily removed by pulling the first cover 20 and the second cover 40 away from each other to deform the spring 10 and thus release the trapped filament from between the plurality of coils 11.

The spring 10 can be manipulated in a variety of different ways by changing the direction and amount of force exerted on the spring through the covers. Although the force exerted through each cover in FIGS. 6 and 7 is equal, such is not required as long as the force exerted is sufficient to deform the spring so gaps occur between the plurality of coils. For example, one of the covers could remain stationary while the other cover is pushed toward it.

Once the filament is held in place between the coils, the coiled spring serves as a backstop to the beads strung on the filament and prevents the sliding of beads off the end of the filament. Two or more securement devices can be used on opposite ends of the filament to prevent the beads from sliding off either end of the filament.

Preferred embodiments of this invention are described herein, including the best mode known to the inventors for carrying out the invention. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

I claim:

1. A device usable to removably secure objects on a wire comprising:

a tension spring having a plurality of coils between a first end and a second end;

a first hook formed at the first end;

a second hook formed at the second end;

a first cover having a first top, a first bottom, a first edge between the first top and the first bottom and a first slot formed in the first edge, the first slot configured to receive the first hook;

a second cover having a second top, a second bottom, a second edge between the second top and the second bottom and a second slot formed in the second edge, the second slot configured to receive the second hook;

wherein the first hook is removably engaged within the first slot on the first cover;

wherein the second hook is removably engaged within the second slot on the second cover, and wherein each of said first and second covers:

is capable of transmitting force and projects outside the area of the coils providing a mechanical advantage by serving as a lever arm extension of the spring coil end member, reducing the overall force needed to be applied to distort the spring in operation; and is flattened so that force from the manipulation of the end members may be distributed over a surface area which is wider than the wire area of a single coil, reducing user discomfort.

2. The device of claim 1 wherein the tension spring is deformable by pressing the first top opposite the first slot and the second top opposite the second slot toward each other thereby opening space between the plurality of coils within which the wire is positionable.

3. The device of claim 1 wherein the tension spring is deformable by pressing the first top opposite the first slot toward the second top opposite the second slot thereby opening space between the plurality of coils within which the wire is positionable.

4. The device of claim 1 wherein the tension spring is deformable by causing the first bottom opposite the first slot and the second bottom opposite the second slot to move away from each other thereby opening space between adjacent coils within which the wire is positionable.

5. The device of claim 1 wherein the first top and the second top are textured.

6. The device of claim 1 wherein the first slot and second slot are U-shaped, said first slot having a first support tab and a second support tab formed on opposite sides thereof and said second slot having a third support tab and a fourth support tab formed on opposite sides thereof.

7. The device of claim 1 wherein when the first cover and the second cover are engaged with the tension spring, the first top and the second top face away from each other and the first bottom and the second bottom face toward each other.

8. The device of claim 1 wherein the first cover and the second cover are composed of material capable of transmitting force chosen from the group comprising: plastic, metal and rubber.

9. The device of claim 1 wherein the tension spring is composed of material chosen from the group comprising: metal and plastic.

10. The device of claim 1 wherein the tension spring is coated with material chosen from the group comprising: plastic and rubber.

11. The device of claim 1 wherein the first bottom further comprises a first retaining member and the second bottom further comprises a second retaining member.

12. A device used usable to removably secure beads on a filament comprising:

a tension spring, a first cover and a second cover;

wherein the tension spring further comprises a plurality of helical coils between a first end and a second end;

wherein the first cover further comprises a first top, a first bottom and a first rim between the first top and the first bottom; the first top further comprising a textured portion; the first bottom further comprising a first retaining portion; the first rim further comprising a first top slot edge aligned with the first top and a first bottom slot edge aligned with the first bottom whereby the first top edge and the first bottom edge are connected together by a first side edge and a second side edge thereby defining a first slot; the first top slot edge being U-shaped and the first bottom edge being U-shaped and having a first support tab and a second support tab formed on opposite sides thereof;

wherein the second cover further comprises a second top, a second bottom and a second rim between the second top and the second bottom; the second top further comprising a textured portion; the second bottom further comprising a second retaining portion; the second rim further comprising a second top slot edge aligned with the second top and a second bottom slot edge aligned with the second bottom whereby the second top and the second bottom are connected together by a third side edge and a fourth side edge thereby defining a second slot; the second top slot edge being U-shaped and the second bottom edge being U-shaped and having a third support tab and a fourth support tab formed on opposite sides thereof;

wherein when the first cover is removably secured to the tension spring, the first end resides within the first slot, the first end abuts the first top slot edge and the plurality of helical coils reside over the first retaining member;

wherein when the second cover is removably secured to the tension spring, the second end resides within the second slot, the second end abuts the second top edge and the plurality of helical coils reside over the second retaining member;

wherein when the first cover is removably secured to the tension spring and the second cover is removably secured to the tension spring, the tension spring is deformed by pressing the first top opposite the first slot and the second top opposite the second slot toward each other thereby opening space between the adjacent plurality of helical coils within which the filament is positionable; and wherein each of said first and second covers:

is capable of transmitting force and projects outside the area of the helical coils providing a mechanical advantage by serving as a lever arm extension of the spring coil end member, reducing the overall force needed to be applied to distort the spring in operation; and is flattened so that force from the manipulation of the end members may be distributed over a surface area which is wider than the wire area of a single coil, reducing user discomfort.

* * * * *